United States Patent [19]

John

[11] Patent Number: 4,614,186

[45] Date of Patent: Sep. 30, 1986

[54] AIR SURVIVAL UNIT

[75] Inventor: Tom T. John, St. Petersburg, Fla.

[73] Assignee: Molecular Technology Corporation, Middlebranch, Ohio

[21] Appl. No.: 672,802

[22] Filed: Nov. 19, 1984

[51] Int. Cl.[4] ..... A62B 7/10

[52] U.S. Cl. ..... 128/201.25; 128/201.26; 128/205.23; 128/205.29

[58] Field of Search ..... 128/201.13, 201.18, 128/201.22, 201.25–201.26, 201.28–201.29, 205.12–205.13, 205.23–205.25, 205.27–205.29, 206.12

[56] References Cited

U.S. PATENT DOCUMENTS

| | | | |
|---|---|---|---|
| 2,284,053 | 5/1942 | Hermann | 128/205.13 |
| 2,575,483 | 11/1951 | Bethig | 128/206.12 |
| 2,610,624 | 9/1952 | Haller et al. | 128/205.29 |
| 2,881,758 | 4/1959 | Motsinger | 128/201.29 |
| 3,559,642 | 2/1971 | Cupp | 128/201.29 |
| 3,565,068 | 2/1971 | Bickford . | |
| 3,615,233 | 10/1971 | Doering | 128/205.28 |
| 4,005,708 | 2/1977 | Netteland et al. | 128/205.28 |
| 4,213,453 | 7/1980 | Warncke et al. | 128/205.28 |
| 4,452,240 | 6/1984 | Moretti | 128/201.18 |

FOREIGN PATENT DOCUMENTS

| | | | |
|---|---|---|---|
| 13349 | of 1885 | United Kingdom | 128/201.29 |

*Primary Examiner*—William E. Kamm

*Attorney, Agent, or Firm*—Sand & Hudak Co.

[57] ABSTRACT

An emergency breathing device for use in a toxic environment including a clear plastic hood having sealing means about the neck or body to form a generally airtight enclosure about the wearer's head. A canister containing carbon dioxide and water vapor adsorbent material is mounted on a mouthpiece which is located completely within the hood. The mouthpiece directs inhaled air directly into the mouth and directs exhaled air through the adsorbent material before discharging it into the hood interior. An oxygen enriched carbon molecular sieve may be located within the canister whereby oxygen molecules trapped within the sieve are replaced by the carbon dioxide and/or water vapor and are liberated into the hood to enrich the oxygen concentration thereof to extend the breathing time of the wearer. An external hand operated pump may be connected by a hose through an inlet port in the hood to supply small amounts of ambient makeup air into the hood after the air passes through a cartridge mounted on the pump to remove any harmful toxins in the incoming makeup air to extend even further the breathing time of the wearer. A nose sealing device is provided to insure that all inhaled and exhaled air enters and leaves through the mouthpiece and not through the nose of the user.

14 Claims, 8 Drawing Figures

AIR SURVIVAL UNIT

TECHNICAL FIELD

The invention relates to breathing apparatus and particularly to an inexpensive, effective, self-contained emergency breathing unit. More particularly, the invention relates to such a unit which removes the water vapor and carbon dioxide from the exhaled breath which reduces the rate of depletion of the oxygen within a hood covering the user's head, and provides for oxygen liberation to maintain the oxygen concentration within the head at a safe level.

BACKGROUND ART

Fires, chemical spills, toxic fumes and odors are an ever present danger to occupants of buildings, factories, mines, or the like, especially when an escape route or exit from the location is not readily available. Various portable devices have been devised to assist an occupant of such an area to escape from or remain for a limited time in the toxic environment before exhausting a breathable air supply. Many of these prior devices are provided with some types of oxygen canister of generator which produces oxygen which is fed into a mask or mouthpiece for breathing by the user. Still other types of devices attempt to reduce the rate of depletion of the breathable air and oxygen within a confined space, such as a hood, by the use of an adsorbent which removes the carbon dioxide and water vapor from the exhaled breath, which if not removed would hasten the depletion or lessen the percentage of oxygen in the remaining air.

Examples of such prior air survival units or breathing apparatus are illustrated in U.S. Pat. Nos. 148,868; 1,298,404; 2,045,907, 3,277,890, 3,604,416; and 4,231,359.

Although many of these prior devices are satisfactory in certain aspects and serve the desired function most of them are relatively expensive and bulky making them difficult to be stored in a compact space or carried by an individual. Many of these prior survival units use a mask or mouthpiece which fits tightly against the person's face covering the nose, mouth and eyes. These devices may not form an airtight seal for all individuals, for example, those having a beard.

Other of these prior devices use a hood which covers the user's head but requires that the source of oxygen which is located externally of the hood enter the hood by a tube such as shown in U.S. Pat. No. 3,565,068. This tube prevents an efficient airtight seal to be formed around the user's neck. Also, most of these prior devices require an externally located oxygen generation unit, such as shown in U.S. Pat. No. 3,565,068, which is either a pressurized canister of oxygen or an oxygen candle for producing the oxygen. These external oxygen supply units although providing a source of oxygen for the user can be dangerous, especially in a fire since they could increase the rate of combustion should they be exposed to an open flame.

Most of these prior devices only remove the carbon dioxide from the exhaled breath and not the water vapor which contributes considerably to the depletion of the remaining oxygen within an enclosed space such as a hood or face mask. Still another problem with known devices is that the particular adsorbents used to adsorb or remove the carbon dioxide and water vapor from the exhaled breath may become contaiminated over a considerable inactive time period rendering the device ineffective at the time of emergency.

Therefore, there is a need for an improved air survival unit which is compact, relatively inexpensive and lightweight which enables the user to breathe in a toxic environment for a sufficient period of time to escape therefrom, and in which means can be provided to increase the time that the user may remain in the hazardous environment.

DISCLOSURE OF THE INVENTION

Objectives of the invention include providing an air survival unit which is relatively inexpensive, lightweight, and compact, which enables the user to breathe for a sufficient time while escaping from hazardous surroundings without the use of an external supply of oxygen by removing carbon dioxide and water vapor from the exhaled breath to reduce the depletion of the oxygen within the air remaining within a hood that covers the user's head. Another objective is to provide such an improved survival unit which includes a mouthpiece having a removable mounted canister thereon that contains a carbon dioxide and water vapor adsorbent material and which may include color changing materials which indicate the level of contamination from water vapor or other contaminates in the canister prior to using the same, to provide a visual indication that the canister is suitable for use even after remaining in storage for a considerable period of time.

A further objective of the invention is to provide such an improved survival unit in which an oxygen enriched molecular sieve of the general class of "zeolites" or carbon based material having a high affinity for oxygen may be located within the main canister or attached thereto by a secondary canister for releasing oxygen into the confines of the enclosure hood when contacted by the carbon dioxide or water vapor contained in the exhalent which increases the time that the user can remain in the hazardous environment while maintaining sufficient oxygen concentration levels and breathable air within the enclosure hood. Still another objective is to provide such a survival unit in which a manually operated handpump may be located externally of the sealed hood for supplying ambient air into the hood after passing the air through a purifying cartridge mounted on the handpump to increase even further the length of time that the user may remain in the hazardous environment by supplying sufficient quantities of makeup air into the hood to maintain a breathable atmosphere therein.

Another objective is to provide such an improved survival unit in which the hood is formed of a flameresistant, gas impermeable, transparent plastic film which provides complete face and eye protection without effecting visibility for the user, and which provides free mobility to the user because no hookups or connections to sources outside of the hood are required unless an optional manually operated handpump is used to provide makeup air. Likewise, no physical obstructions or protrusions violate the integrity of the bag. Still another objective of the invention is to eliminate the need for an oxygen generator or canister which is inherently unsafe in a fire situation because of the danger of explosion and the contribution of oxygen to the combustable material when in use and the development of possible dangerous high pressures in the hood at elevated temperatures, by the use of a molecular sieve enriched with oxygen which is liberated by the exhaled carbon dioxide and/or water vapor and not generated as in prior devices.

A further objective of the invention is to provide such a survival unit in which the length of breathing time provided by the unit may be increased by the use of the oxygen enriched molecular sieve, either of the "zeolite" class or carbon based material having a high affinity for oxygen, and by the external handpump; and in which the mouthpiece insures that the inhaled air enters directly into the mouth of the user and that the exhaled air is directed through the adsorbent material before being exhausted into the confines of the enclosure bag.

These objectives and advantages are obtained by the improved air survival unit of the invention, the general nature of which may be stated as including a transparent lightweight flexible hood adapted to completely cover the head of the wearer including sealing means for sealing the hood tightly about the neck of the wearer to form a generally airtight enclosure; a canister adapted to be located completely within the hood, said canister being formed with a chamber means for containing a carbon dioxide and a water vapor adsorbents; and a mouthpiece attached to the canister for directing inhaled air from within the hood directly into the wearer's mouth through the mouthpiece and for directing exhaled air directly through the carbon dioxide and water vapor adsorbents before discharging it into the hood whereby most of the carbon dioxide and water vapor is removed from the exhaled air enabling the oxygen concentration within the hood to deplete at a slower rate providing increased breathing time for the user.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

The improved air survival unit is indicated generally at 1, and is shown particularly in FIGS. 1–4. Unit 1 includes a hood 2 which is made of a gas impermeable, flame resistant, transparent plastic film, preferably in a generally cylindrical configuration to provide a recycle air reservoir therein which surrounds a user's head, while providing protection to the user's face and eyes without materially reducing his visibility. Hood 2 is provided with a bottom opening through which the user's head is inserted into the hood interior and is provided with a sealing strip 4 preferably formed of hook and pile materials 5 and 6, such as sold under the trademark Velcro, which matingly engage each other to form a secure fastening engagement therebetween. Sealing strip 4 enables hood 2 to be sealed tightly about the neck of the wearer providing generally airtight reservoir 7 within the bag interior.

Figure 2:
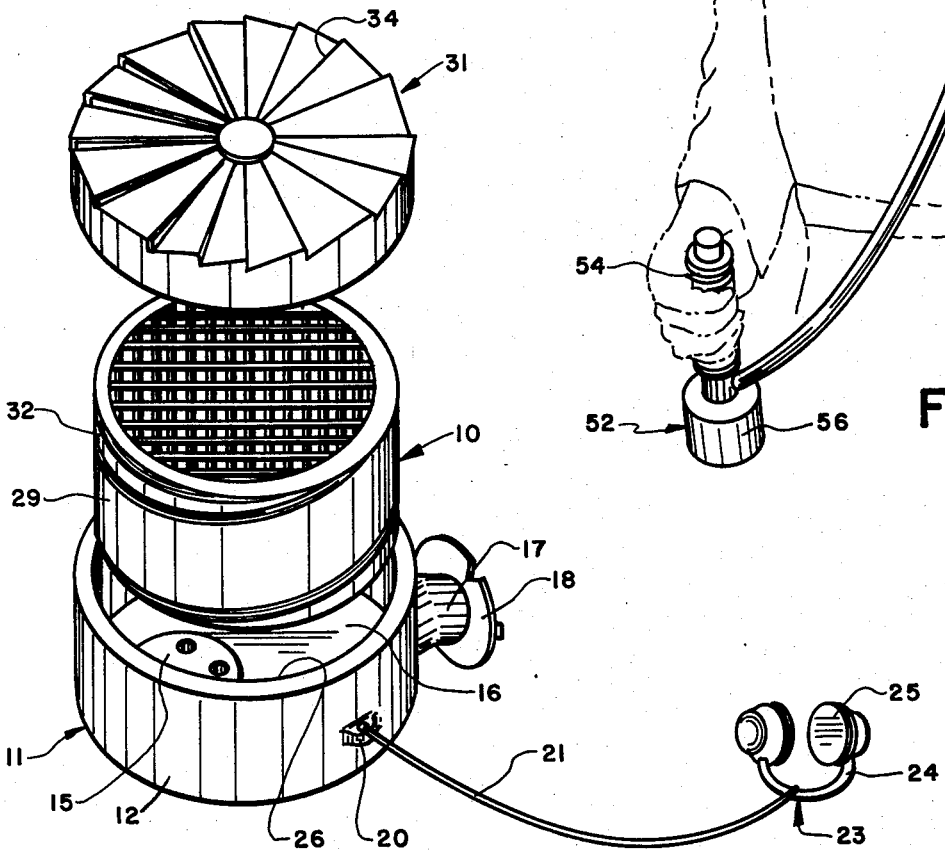
FIG. 2 is an exploded perspective view of the improved air survival unit.
Figure 3:
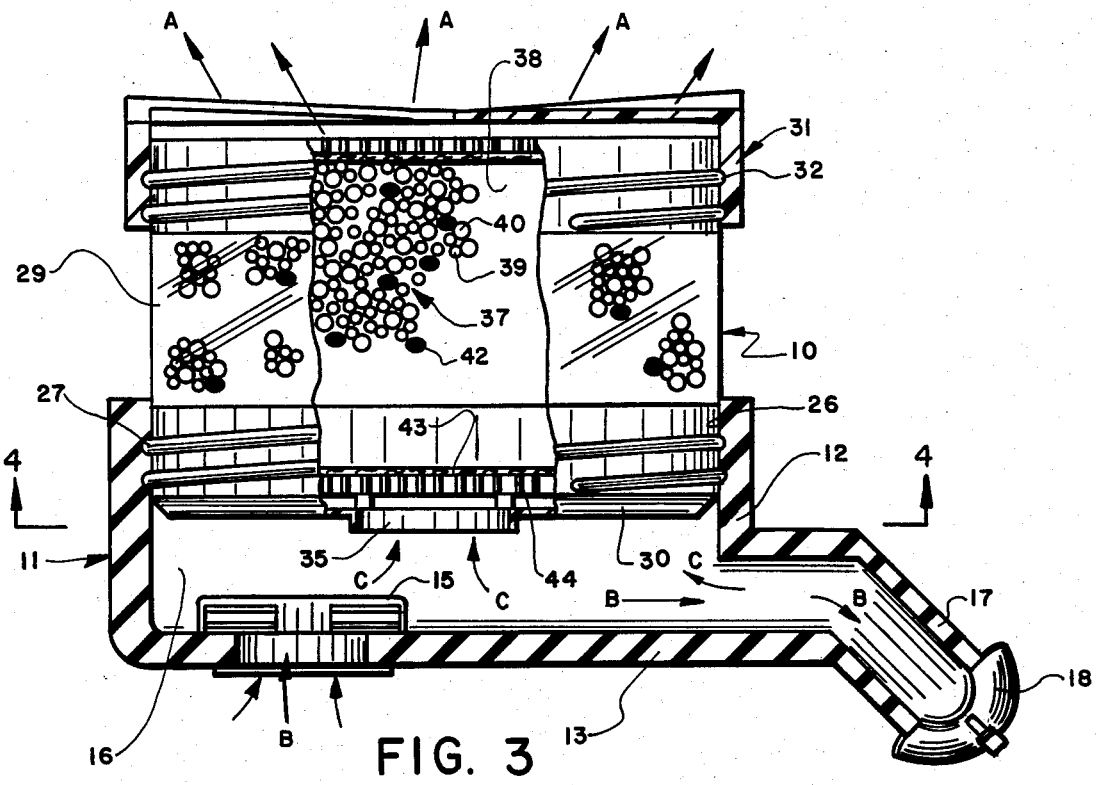
FIG. 3 is an enlarged sectional view with portions broken away of the air survival unit of FIGS. 1 and 2.

A canister indicated generally at 10, is removably mounted on a mouthpiece, indicated generally at 11 (FIGS. 2 and 3). Mouthpiece 11 preferably is molded of a semi-rigid plastic or synthetic rubber material having a cylindrical configuration provided by a side wall 12 and a bottom wall 13. A one-way check valve 15 is mounted in bottom wall 13 and communicates with a hollow interior 16 of mouthpiece 11. A hollow stem 17 is formed integrally with side wall 12 and extends outwardly downwardly therefrom and terminates in a flaired end 18 which is adapted to be inserted into the mouth of the user with stem 17 functioning as a breathing tube. Hollow stem 17 communicates with the interior 16 of mouthpiece 11 as shown in FIG. 3 for transferring air from a user's mouth into and out of interior 16.

A lug 20 as shown in FIG. 2 preferably is formed integrally with side wall 12 for attaching a flexible cord 21 thereon which is connected at its other end to a nose seal, indicated generally at 23. Nose seal 23 is formed by a U-shaped spring wire 24 connected to a pair of nose clamping plugs 25. Nose seal 23 enables an individual to close his nostrils if desired, to insure that his breathing is always done into and out of his mouth and through mouthpiece 11 without any air being inhaled or exhaled through the nose which would defeat the purpose of the device. By attaching nose seal 23 to the mouthpiece, it insures that it will be with unit 1 when needed at the time of an emergency. The end of mouthpiece wall 12 opposite of bottom wall 13 is open at 26, and preferably thread receiving grooves 27 are formed in the inside surface of wall 12 adjacent top opening 26 for removably mounting canister 10 thereon.

Canister 10 preferably has a cylindrical configuration formed by cylindrical side wall 29 (FIGS. 2 and 3) having a bottom wall 30 and a top closure cap 31. Cap 31 is removably mounted on the upper end of side wall 29 by a threaded connection 32 and is formed with a plurality of openings 34 (FIG. 8), which can be of various configurations and sizes, through which the exhaled breath (arrows A) is dispelled into air reservoir 7 of hood 2 as described more fully below. Bottom wall 30 is formed with a central opening 35 which communicates with hollow interior 16 of mouthpiece 11.

Figure 5:
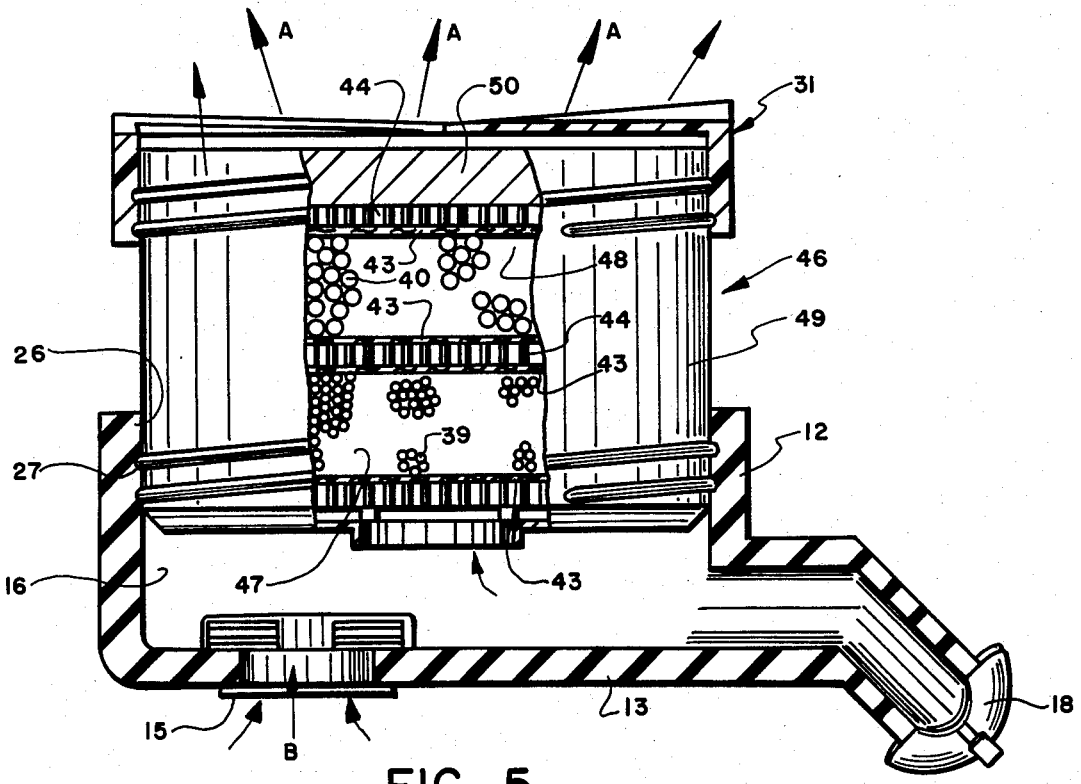
FIG. 5 is a sectional view with portions broken away similar to FIG. 3, showing a modified form of the improved air survival unit.
Figure 4:
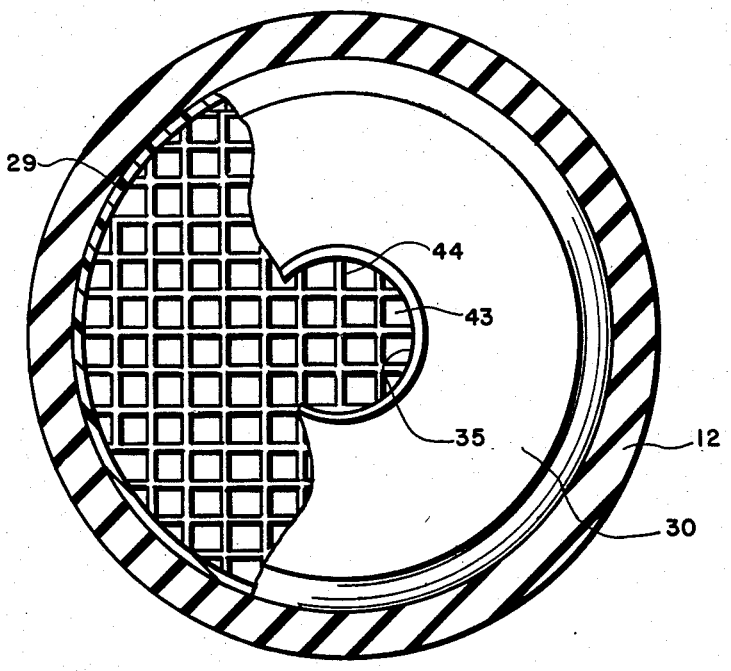
FIG. 4 is a sectional view with portions broken away, taken on line 4—4, FIG. 3.

In accordance with one of the features of the invention a carbon dioxide and water vapor adsorbing material indicated generally at 37, is located within hollow interior chamber 38 of canister 10. Adsorbing material 37 usually will consist of two separate chemicals preferably silica gel pellets 39 for removing the water vapor and lithium hydroxide pellets 40 for removing the carbon dioxide. These two chemical pellets may be mixed together and located with a single chamber as shown in FIG. 3, or may be separated in a modified form of the invention as shown in FIG. 5. Also, a plurality of color changing pellets 42 may be intermingled with pellets 39 and 40 which are visible through transparent side wall 29 which will change colors if exposed to moisture. This provides a visual indication that the adsorbent pellets have not been contaminated by ambient air when in storage and prior to being used, enabling an individual to rapidly determine upon routine inspection that survival unit 1 is still able to perform its intended function even if maintained in storage for a considerably long period of time. Pellets 42 also provide an indication even after use of unit 1 that the pellets have not absorbed sufficient water vapor to render the unit unusable. Pellets 42 are commercially available pellets and may be of various chemical compositions.

A felt disc 43 and grid disc 44 preferably are located adjacent bottom wall 30 and the top of canister 10 to maintain pellets 39, 40 and 42 within interior 38, while permitting the passage of air into and out of canister interior 38. Felt discs 43 may be formed of various porous types of materials which prevents the passage of pellets 39 and 40 therethrough yet which enables air to move rapidly through the material and grid discs 44 which preferably are formed of plastic.

Figure 1:
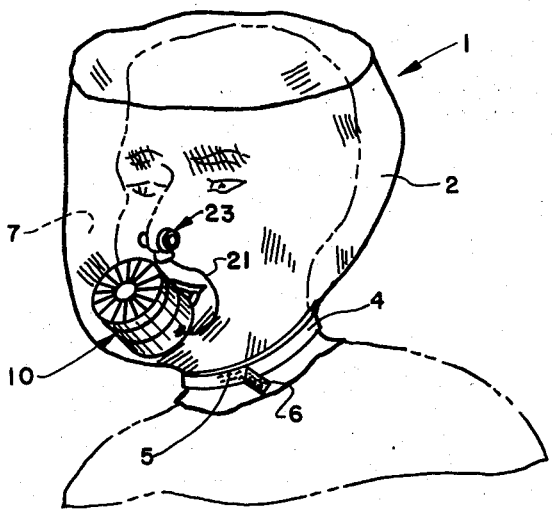
FIG. 1 is a diagrammatic perspective view of the improved air survival unit being used by an individual.

The operation of improved air survival unit 1 is best illustrated in FIG. 1. Upon first indication of a toxic environment being experienced by an individual, he or she merely places flared end 18 of the mouthpiece in the mouth and the nostrils are sealed by application of nose seal 23. Next the user unfolds bag 1 which is located in a convenient storage container or location and places it over his head and secures strip 4 tightly around the neck to block out the flow of air. Upon inhaling, air is drawn into the mouth-piece interior 16 through check valve 15, as shown by arrows B (FIG. 3), through hollow stem 17 and into the user's mouth and lungs. The exhaled breath then returns through tube 17 (arrows C) into mouthpiece interior 16, and through bottom wall opening 35 of canister 10 and through the adsorbents 37. Material 37 removes most of the carbon dioxide and water vapor contained in the exhaled breath whereby the remaining air (arrows A) is exhaled through cap openings 34 and into the interior of hood 2. This exhaled breath (arrow C) must flow through absorbing material 37 since check valve 15 prevents it from being exhaled in any other manner from mouthpiece interior 16.

This same exhaled air (arrows A) is then circulated throughout the hood interior or air reservoir 7 and is drawn back into mouthpiece 11 through check valve 15 (arrows B) for subsequent rebreathing where the same purifying process is preformed on the exhaled breath. This constant rebreathing of the circulated air within air reservoir 7 of hood 2 will finally be depleted of the usuable oxygen and require the wearer to leave the toxic environment or supply reservoir 7 with makeup oxygen or nontoxic ambient air. Due to the removal of the water vapor and carbon dioxide from the exhaled breath the concentration of usable oxygen in the remaining air in hood 2 depletes at a considerably slower rate than if the carbon dioxide and water vapor were not removed from the exhaled breath. This arrangement has been found to provide between five and ten minutes of breathable air before the wearer has to exit the toxic environment or be supplied with additional makeup air or oxygen. In most emergency situations this 5 to 10 minutes of breathable air supply is sufficient time to enable an individual to escape a hazardous environment.

A modified form of air survival unit 1 is shown in FIG. 5 and is indicated generally at 46. Unit 46 is similar in most respects to unit 1 except that silica jel pellets 39 and lithium hydroxide pellets 40 are located in separate chambers 47 and 48 within the hollow interior of canister 49 separated by a pair of felt pads 43 and a grid disc 44. The cylindrical side wall of canister 49 may be opague as shown in FIG. 5 or transparent as shown in FIG. 3 in which situation color changing pellets 42 may also be located in the canister.

In accordance with one of the features of the invention, a molecular sieve 50 is located in an upper portion of canister 49 within sealing end cap 31. Molecular sieve 50 is a commercially available component and preferablly is a crystalline zeolite or a carbon adsorbent which has been modified to produce regular controlled pore sizes of a molecular range of 2 to 5 Angstroms. The adsorbent is impregnated with oxygen molecules which are liberated by the carbon dioxide or water vapor molecules upon passing through the sieve. There is only oxygen liberation and not generation as in prior breathing devices. Therefore it is inherently safe in a fire situation and there is no danger of explosion or oxygen contribution should it be consumed by fire when not in use. Furthermore, when in use the device will not develop high pressure in the bag or dangerous concentration levels at elevated temperatures.

Oxygen enriched molecular sieves 50 becomes activated only when the other molecular sieves or adsorbents materials 39 and 40 become saturated and do not remove sufficient amounts of water vapor and/or carbon dioxide. This liberated oxygen mixes with the air in reservoir 7 within hood 2 extending even further the breathing time to the user of the unit before having to exit the toxic environment. Molecular sieve 50 may impart a very slight amount of oxygen into hood 2 even before adsorbents 39 and 40 become saturated since these materials usually will not remove 100% of the water vapor and carbon dioxide contaiminates, and upon these small amounts of contaminates passing through sieve 50 some oxygen will be liberated and flow into the hood.

Figure 6:
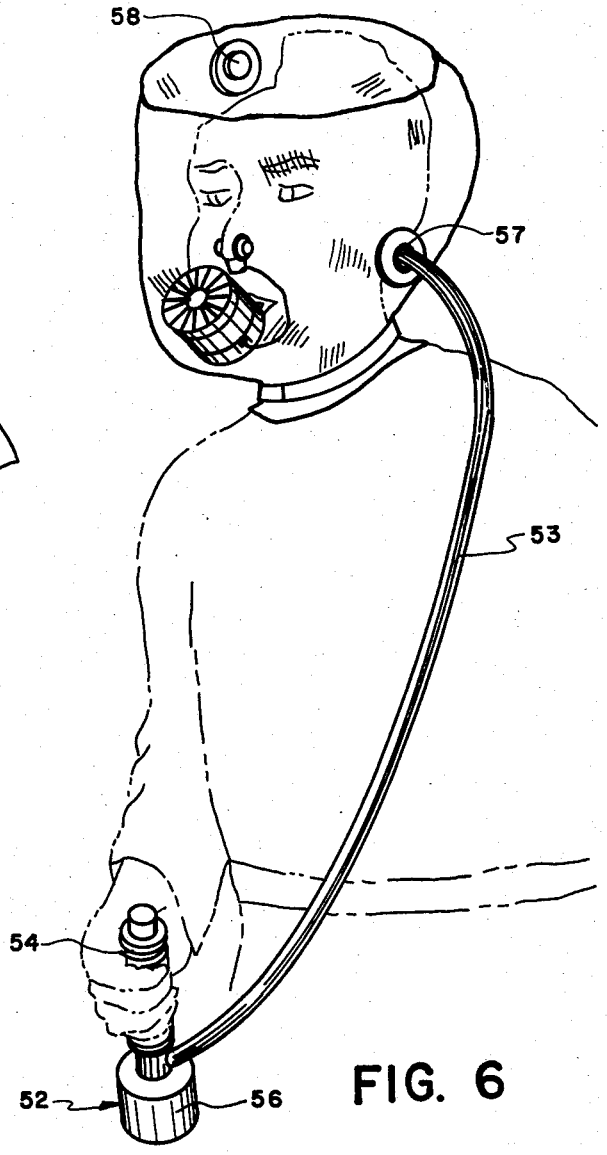
FIG. 6 is a diagrammatic perspective view similar to FIG. 1, showing the modified air survival unit of FIG. 5 being used with a hand actuated pump.
Figure 7:
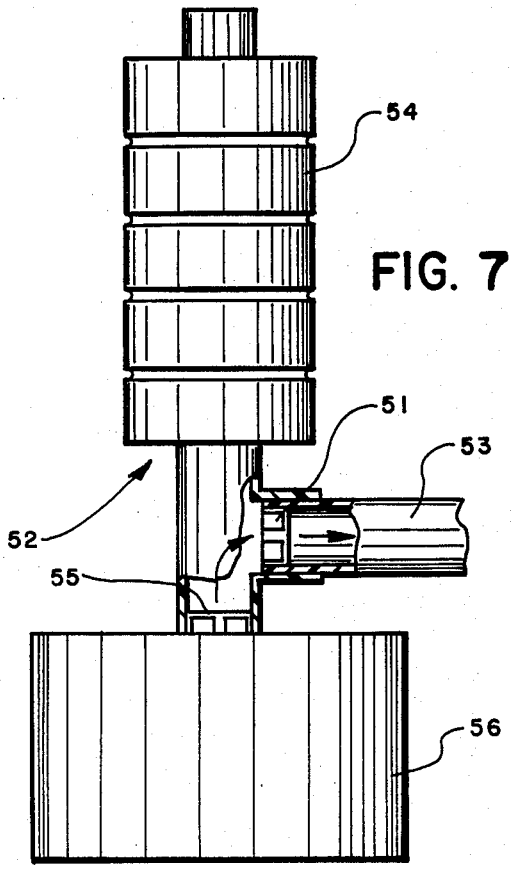
FIG. 7 is an elevational view of a type of handpump to be used with the modified embodiment as shown in FIG. 6, with portions broken away and in section.

FIGS. 6 and 7 show still another modification to air survival units 1 and 46 in which a manually operated handpump 52 is connected to hood 2 through a hose 53. Handpump 52 is of a usual construction consisting of a collapsible bellows 54 which draws air into its interior through a one-way check valve 55 where it flows through another check valve 51 and then through tube 53 and into the interior of hood 2. Hose 53 communicates with the interior of hood 2 through an inlet port attachment 57 eliminating any violation of the integrity of the hood seal as in prior devices. A vent 58 is provided to release surplus air.

Figure 8:
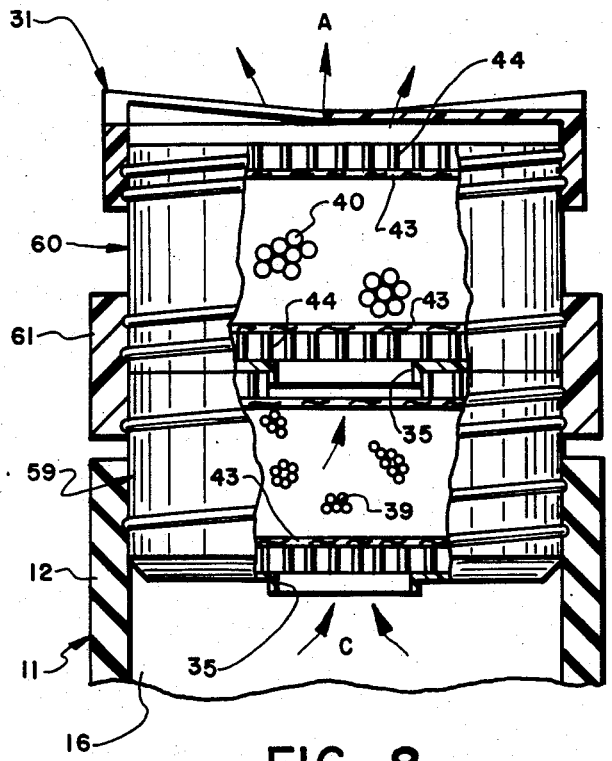
FIG. 8 is a fragmentary view with portions broken away and shown in section of the absorber canister being compressed of two separate canister sections.

FIG. 8 shows another modification of air survival unit 1 in which canister 10 is formed by two separate canister sections indicated at 59 and 60. The canister sections are similar to canister 10 and are joined by a threaded coupling ring 61 or the like. Each section 59 and 60 contain one of the two adsorbent materials such as the silica gel pellets and lithium hydroxide pellets. Although not shown in FIG. 8, molecular sieve 50 may be mounted in closure cap 31 at the top of canister body section 60. With this arrangement, the adsorbent pellets may be packaged in replaceable canister sections for mounting on mouthpiece 11 which is reusable together with end cap 31.

Accordingly, the improved air survival unit provides a device that is relatively inexpensive, reliable, which has a long shelf life and which allows the wearer to escape from smoke, chemical, vapor or other types of toxic environment. Furthermore, the improved air survival unit can be provided with oxygen enriched molecular carbon sieve 50 which enables the usable time of the unit to be increased without substantially increasing its cost and compactness, and in which a manually operated, extremely inexpensive handpump may be used to extend even further the usable time of the unit when used in certain types of toxic environments. Also, the particular adsorbent materials and color changing pellets which indicate its readiness condition can be replaced with other types of chemicals which will remove the carbon dioxide and water vapor and indicate the presence of moisture or contamination other than the particular examples set forth above without effecting the concept of the invention. Furthermore, the oxygen enriched molecular sieve may have various configurations than that shown above so long as it provides a device to enable the oxygen trapped within the sieve to be liberated upon contact with the carbon dioxide or water vapor or other chemicals contained in the exhaled breath. Most importantly, the canister and mouthpiece, and oxygen liberation sieve 50 are all located within hood 2 eliminating any external devices or attachments.

Accordingly, the improved air survival unit is simplified, provides an effective, safe, inexpensive, and efficient device which achieves all the enumerated objectives, provides for eliminating difficulties with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved air survival unit is constructed and used, the characteristics of the construction, and the advantageous, new and useful results obtained; the new and useful structures, devices, elements, arrangements, parts, and combinations, are set forth in the appended claims.

What is claimed is:

1. An air survival unit including:

(a) a transparent lightweight flexible hood adapted to completely cover the head of the wearer including sealing means for sealing the hood tightly about the neck or body of the wearer to form a generally airtight enclosure;

(b) a canister located completely within the airtight enclosure of the hood, said canister being formed with a chamber means containing a carbon dioxide and a water vapor adsorbents; and (c) a mouthpiece attached to the canister for directing inhaled air from within the hood directly into the wearer's mouth through the mouthpiece and for directing exhaled air directly through the carbon dioxide and water vapor adsorbents before discharging it into the hood whereby most of the carbon dioxide and water vapor is removed from the exhaled air enabling the concentration of oxygen within the hood to deplete at a slower rate providing increased breathing time for the user.

2. The air survival unit defined in claim 1 in which the hood is formed of a flame resistant plastic film; and in which the sealing means is achieved by hook and pile mating fastener materials.

3. The air survival unit defined in claim 1 in which the chamber means includes a first chamber containing a mixture of carbon dioxide and water vapor absorbing granules.

4. The air survival unit defined in claim 3 in which at least a portion of the first chamber is formed by transparent material enabling the adsorbent granules to be visible within the first chamber; and in which color changing material is contained in the carbon dioxide and water vapor adsorbent granules to indicate the presence of moisture within the canister chamber by changing the color of said material.

5. The air survival unit defined in claim 3 in which the chamber means includes a second chamber in communication with the first chamber; and in which an oxygen impregnated sieve is located within the second chamber to release oxygen into the interior of the hood upon contact of carbon dioxide or water vapor with said molecular sieve.

6. The air survival unit defined in claim 5 in which a grid and a layer of porous material is located between and separates the second chamber which contains the oxygen enriched molecular sieve from the first chamber.

7. The air survival unit defined in claim 1 in which an oxygen enriched carbon molecular sieve is located within the chamber means and is formed with pore sizes of a molecular range of 2 to 5 Angstroms.

8. The air survival unit defined in claim 1 in which the canister and mouthpiece are each formed with threaded portions which are engaged with each other removably attaching the canister to the mouthpiece.

9. The air survival unit defined in claim 1 in which a nose sealing device is located within the hood for blocking the inflow of air into the nose of a wearer to insure that both the inhaled air and exhaled breath pass through the mouthpiece; and in which a length of flexible cord is attached to and extends between the nose sealing device and canister attaching said sealing device to the canister.

10. The air survival unit defined in claim 1 in which a hand operated pump is located externally of the hood; in which an inlet port is formed on the hood supplying ambient air into the interior of the hood; in which a hose extends between the pump and inlet port; and in which an air purifying cartridge located on the pump removes harmful toxins from the air before pumping it into the interior of the hood to extend the period of time that the wearer can breath within a hazardous environment.

11. The air survival unit defined in claim 10 in which the pump is a flexible bellows easily compressed by the user to draw ambient air through the cartridge and into the hood.

12. The air survival unit defined in claim 11 in which check valve means is formed in the hood for permitting air to escape from the hood to maintain the pressure equalized within the hood due to the inflow of air into the hood by the handpump.

13. The air survival unit defined in claim 1 in which the carbon dioxide adsorbent is lithium hydroxide and the water vapor adsorbent is silica gel.

14. The air survival unit defined in claim 13 in which the chamber means includes a first chamber containing the lithium hydroxide, a second chamber containing the silica gel, and a third chamber containing an oxygen enriched carbon molecular sieve.

* * * * *